United States Patent [19]

Lersmacher et al.

[11] 4,392,238

[45] Jul. 5, 1983

[54] ROTARY ANODE FOR AN X-RAY TUBE AND METHOD OF MANUFACTURING SUCH AN ANODE

[75] Inventors: Bernhard Lersmacher, Aachen; Hans Lydtin, Stolberg, both of Fed. Rep. of Germany

[73] Assignee: U.S. Philips Corporation, New York, N.Y.

[21] Appl. No.: 167,950

[22] Filed: Jul. 14, 1980

[30] Foreign Application Priority Data

Jul. 18, 1979 [DE] Fed. Rep. of Germany ..... 2928993

[51] Int. Cl.[3] ..... H01J 35/10

[52] U.S. Cl. ..... 378/144; 378/125; 313/311

[58] Field of Search ..... 313/311, 330; 378/143, 378/144, 124, 125

[56] References Cited

U.S. PATENT DOCUMENTS

| | | | |
|---|---|---|---|
| 3,539,859 | 11/1970 | Bougle | 313/311 |
| 3,591,822 | 7/1971 | Katz | 313/311 |
| 3,710,162 | 1/1973 | Bougle | 313/330 |
| 3,969,131 | 7/1976 | Fatzer et al. | 313/330 |
| 3,982,148 | 9/1976 | Kaplan et al. | 313/330 |
| 4,090,103 | 5/1978 | Machenschalk et al. | 313/311 |
| 4,132,917 | 1/1979 | Bildstein et al. | 313/311 |
| 4,335,327 | 6/1982 | Waugh et al. | 378/144 |

FOREIGN PATENT DOCUMENTS

| | | | |
|---|---|---|---|
| 2061007 | 6/1972 | Fed. Rep. of Germany | 313/330 |
| 2146918 | 3/1973 | Fed. Rep. of Germany | 313/330 |
| 2152049 | 4/1973 | Fed. Rep. of Germany | 313/330 |
| 2440988 | 3/1975 | Fed. Rep. of Germany | 378/144 |
| 2910138 | 9/1980 | Fed. Rep. of Germany | 378/144 |

*Primary Examiner*—Saxfield Chatmon, Jr.
*Attorney, Agent, or Firm*—Robert J. Kraus

[57] ABSTRACT

A rotary anode comprising a basic body of carbon whose surface is provided with a pyrolytic graphite coating having a crystallographic layer structure. A metallic layer of high-melting temperature, in which X-rays are generated during operation in an X-ray tube, is provided on the body. The metallic layer and the pyrolytic graphite coating have a common contact face which cuts through the crystallographic layers in the pyrolytic graphite. Heat developed in the metallic layer is discharged through the face into the pyrolytic graphite layers.

7 Claims, 4 Drawing Figures

ROTARY ANODE FOR AN X-RAY TUBE AND METHOD OF MANUFACTURING SUCH AN ANODE

BACKGROUND OF THE INVENTION

The invention relates to a rotary anode comprising a basic body of carbon whose surface is provided with a coating of pyrolytic graphite having a crystallographic layer structure on which there is provided a further metallic layer of a high-melting temperature in which X-rays are generated during operation in an X-ray tube. The invention furthermore relates to a method of manufacturing such a rotary anode, in which a coating of pyrolytic graphite is deposited on the surface of a basic body of carbon, and a further metallic layer of a high-melting temperature is deposited on the coating of pyrolytic graphite.

A rotary anode of the kind set forth is known from German Offenlegungsschrift No. 21 46 918. The pyrolytic coating thereof serves to obtain smooth surfaces which are free of pores, so that no particles can become detached from the basic body. Due to the absence of pores, the so-termed "after-gasing" is prevented, so that a permanent high vacuum can be comparatively easily maintained. The pyrolytic coating on the basic body of the known rotary anode is deposited by means of known methods. The basic body is heated to a temperature of from 500° to 1200° C. and at the same time a gaseous carbon compound is guided across the basic body, so that carbon is deposited on the basic body.

From German Offenlegungsschrift No. 17 71 980 which corresponds to U.S. Pat. No. 3,410,746, it is known that, when pyrolytic graphite is deposited on a surface from the gaseous phase, the deposited layer exhibits a crystallographic layer structure whose crystal faces generally extend parallel to the surface and parallel with respect to each other. The thermal conductivity of the graphite is much higher in the direction of the crystallographic layers than in the direction transversely thereof. This means that the layer of pyrolytic graphite which is known from German Offenlegungsschrift No. 21 46 918 is less than optionally suited for conducting heat from the layer of high-melting temperature metal to the basic body, because the crystallographic layers in the pyrolytic graphite follow the circumference of the basic body.

SUMMARY OF THE INVENTION

It is an object of the invention to provide a rotary anode in which the metallic X-ray generating layer is maintained at a comparatively low temperature during operation and which, moreover, can be comparatively simply manufactured. To this end, a rotary anode in accordance with the invention is characterized in that the metallic X-ray generating layer and the pyrolytic graphite coating have a common contact face which is formed by cutting through the crystallographic layers in the coating at an angle. Because the metallic layer now contacts a large number of crystallographic layers, the heat developed in the metallic layer can be efficiently discharged.

In order to enable a rotary anode of this kind to be simply manufactured, in a further embodiment of the invention the pyrolytic graphite coating is ground to form such a face prior to the deposition of the metallic layer on the anode.

The basic body is made of, for example, electrographite, foamy carbon, fibre-reinforced carbon, or vitreous carbon.

In order to achieve particularly good heat discharge from the metallic X-ray generating layer, the complete layer of high-melting metal is preferably provided on a ground face located entirely on the ends of the pyrolytic graphite, so that temperature differences in the metallic layer are minimized.

Normal coarse grained pyrolytic graphite has a coefficient of thermal conductivity of approximately 3.4 J/cm. K.s in the direction parallel to the crystallographic layers. Fine grained pyrolytic graphite, such as that used with substrates having a very smooth (polished) surface, has a coefficient of thermal conductivity of approximately 4.2 J/cm. K.s in this direction; and high temperature and stress recrystallized pyrolytic graphite (heat pressed at approximately 3500 K at a pressure of between 10 and 1000 bar) has a coefficient of approximately 5.9 J/cm. K.s. Characteristics and types of suitably-oriented pyrolytic graphites are described by A.W. Moore in "Chemistry and Physics of Carbon", Volume 11, pages 69–187 (published by P.L. Walker jr. and P.A. Thrower). In comparison with customary materials for rotary anodes for X-ray tubes, such as molybdenum and tungsten, the coefficient of thermal conductivity of normal coarse grained pyrolytic graphite is approximately two times higher than that of these materials, while that of fine grained pyrolytic graphite is approximately from two to three times higher, and that of recrystallized pyrolytic graphite is approximately from four to five times higher. Taking into account the thermal conductivity of different kinds of pyrolytic graphite, the thickness of the layers of pyrolytic graphite can be calculated for all practical cases. For normal coarse grained pyrolytic graphite, this thickness amounts to approximately 5 mm in practice; for fine grained pyrolytic graphite, it is approximately 3.5 mm, and for recrystallized pyrolytic graphite it is approximately 2.6 mm.

The layer of recrystallized pyrolytic graphite is preferably made by subjecting the rotary anode, after coating it with pyrolytic graphite, to a thermal treatment at a temperature of from 2500° to 3500° C. The thermal treatment is preferably performed in a vacuum, however, it can alternatively be performed in an inert gas, for example, in argon. During the thermal treatment in an inert gas, preferably a pressure of between 10 and 500 bar is used.

In a further embodiment of a rotary anode in accordance with the invention, the basic body comprises grooves or raised portions in which or on which a thermal conduction barrier is formed by removing parts of the pyrolytic graphite coating by grinding, or in which or on which faces are formed for radiating heat. The extent of these faces can be selected by grinding during which the crystallographic faces are cut through. The emission coefficient of these ground faces is higher than the emission coefficient of a grown surface of the pyrolytic graphite, as is demonstrated by photometric measurements. As a result of the provision of thermal conduction barriers and radiating faces, the drive shaft and the bearings of the X-ray tube are protected against thermal overloading.

In order to ensure that the contact face between the pyrolytic graphite coating and the metallic X-ray generating layer forms as large an angle as possible with respect to the crystallographic layers in the pyrolytic graphite coating, the basic body of a further preferred embodiment in accordance with the invention comprises a raised portion, such as an annular raised portion, at which the pyrolytic graphite coating has been locally removed from the surface by grinding, so that the crystallographic layers of the pyrolytic graphite coating are cut through to form the face. The metallic X-ray generating layer is deposited on the ground face. Angles of up to 90° between the face and the layers are obtainable in this embodiment. The raised portion is preferably made of interconnected, thin anisotropic graphite foils or foils of vitreous carbon.

A rotary anode configured in accordance with the invention offers the following advantages: As a result of the grinding of the crystallographic layers of the pyrolytic graphite, the temperature of the focal path can be maintained at a comparatively low value. The contact face between the metal of the focal path and the basic body can be simply and accurately made by grinding. Due to the direct covering of the basic body with pyrolytic graphite, a superior to that heat conductive connection which results from soldering of these two components is avoided. Thermal barriers and radiating faces can be realized by selective grinding of the pyrolytic graphite coating. As a result, the thermal balance can be controlled within given limits. Moreover, more sensitive parts of X-ray tubes can be selectively protected against thermal overloading. The coating of pyrolytic graphite improves the mechanical properties (strength) of the rotary anode to a substantial degree. This enables larger dimensions (for example, a diameter larger than 150 mm). Due to the provision of the focal path by, for example, reactive deposition from the gaseous phase, soldering and hence heat barriers are again avoided.

BRIEF DESCRIPTION OF THE DRAWING

The invention will be described in detail hereinafter, by way of example, with reference to the accompanying diagrammatic drawing in which.

DESCRIPTION OF THE PREFERRED EMBODIMENTS

Figure 1:
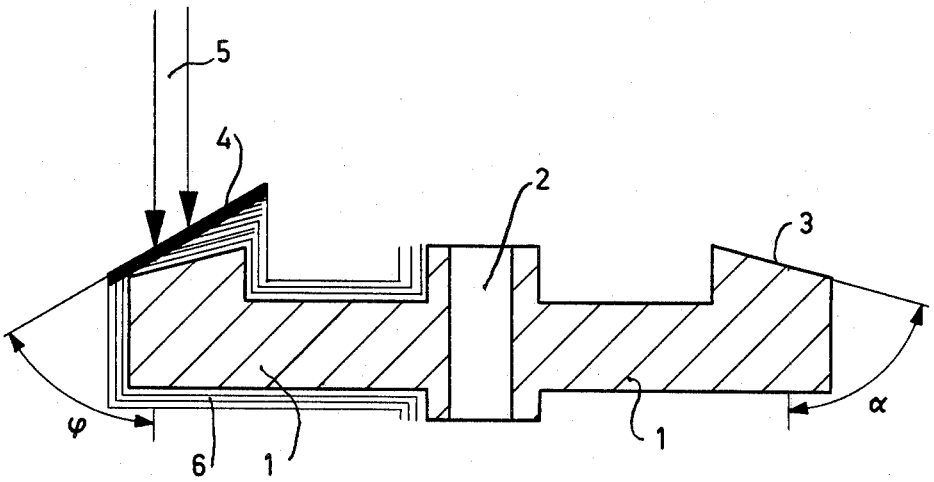
FIG. 1 is a cross-sectional view of a rotary anode in accordance with the invention.

The manufacture of a rotary anode in accordance with the invention will be described with reference to FIG. 1. The right-hand part of this Figure shows a basic body 1 which has not yet been covered. A basic body of this kind, comprising a bore 2 for the drive shaft, is made of, for example, electrographite. The angle of inclination $\alpha$ of a face 3 of the basic body, is a few degrees larger than the angle of inclination $\phi$ of a face which has been covered by a metallic layer 4 of high-melting temperature, to form the X-ray generating focal path. The angles $\phi$ and $\alpha$ are measured with respect to the direction of an incident electron beam 5.

On the basic body a coating 6 of pyrolytic graphite, having a crystallographic layer structure which is diagrammatically indicated, is provided in known manner by deposition from a gaseous phase. Over the face 3, this layer is ground as follows:

The anode disc is clamped in a circular grinding machine. The material is removed, maintaining the angle $\phi$, by means of a silicon carbide grinding disc with an SiC-grain with a diameter of approximately 250–300 μm. It is alternatively possible to remove the material by means of milling in order to form the ground face 3. The material is preferably removed by means of grinding, because the risk of chipping away pieces of material is reduced.

In order to maintain accurate dimensions, the rotary anode is in many cases ground again after applying the pyrolytic graphite coating and before depositing the metallic layer. The metallic layer 4 can be provided on the ground face by depositing of metal from a gaseous phase, for example, tungsten from the system $WF_6+3\ H_2 \rightarrow W+6\ HF$, or by sputtering, flame sputtering or plasma sputtering.

Figure 2:
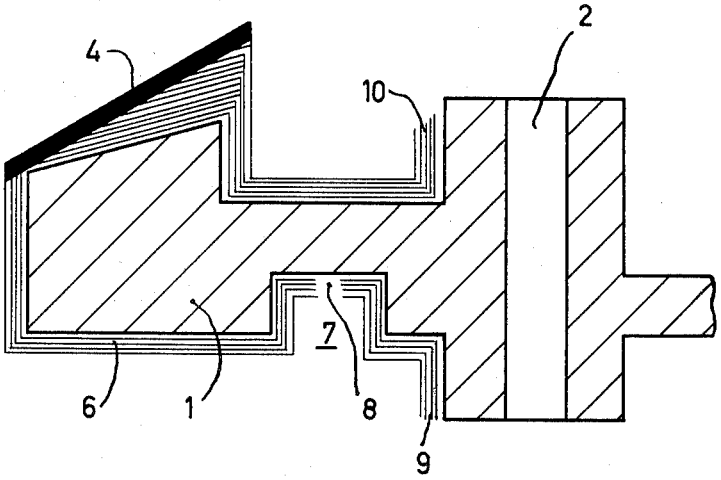
FIG. 2 is a sectional view of a rotary anode provided with a groove.

FIG. 2 shows that the provision of a groove 7 in the basic body 1. The removal of part of the coating 6 in this groove results in a thermal conduction barrier 8. Additional radiating faces 9 and 10 can be formed by grinding away portions of the coating 6.

Figure 3:
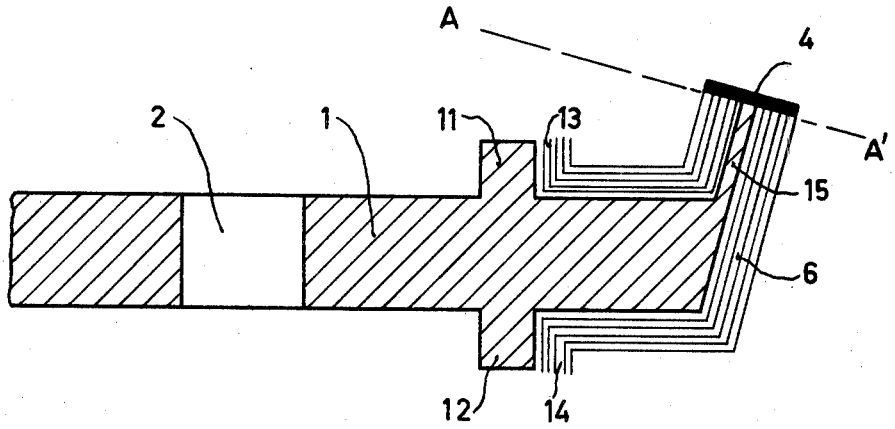
FIGS. 3 and 4 are sectional views of a rotary anode comprising raised portions.
Figure 4:
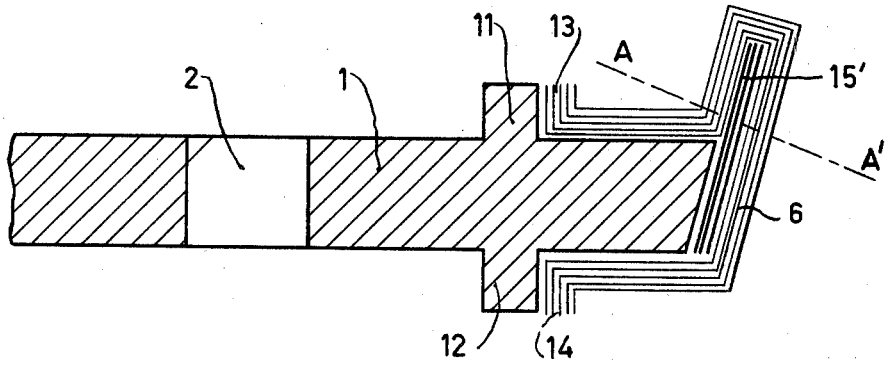

The basic body 1 in the FIGS. 3 and 4 comprises raised portions 11 and 12 on which the coating ends in radiating faces 13 and 14. The basic body 1 alternatively comprises annular raised portion 15 or 15'. In FIG. 3, the coating 6 of pyrolytic graphite is removed from the raised portion 15 by grinding away material to form a face lying in a plane A–A'. The ground face is covered with a layer 4 of high-melting temperature metal.

FIG. 4 shows a layer-like raised portion 15' prior to grinding along the line A–A'.

What is claimed is:

1. A rotary anode for an X-ray tube including:
(a) a carbon body;
(b) a pyrolytic graphite coating on the body's surface, having a plurality of crystallographic layers extending parallel to said surface, said coating being cut through at an angle exposing ends of the crystallographic layers to form a face; and
(c) an X-ray generating metallic layer on said face.

2. A rotary anode as in claim 1 where the carbon body includes a raised annular portion having ends of the cystallographic layers on the portion exposed to form a heat radiating face.

3. A rotary anode as in claim 1 where the carbon body includes a groove in which a gap in the pyrolytic graphite coating on the body is located, said gap serving as a thermal conduction barrier.

4. A rotary anode as in claim 1, 9, 2 or 3 where the carbon body includes a raised annular portion on which the metallic layer is located.

5. A rotary anode as in claim 4, where the raised annular portion on which the metallic layer is located comprises interconnected foils of pressed graphite.

6. A method of manufacturing a rotary anode for an X-ray tube comprising:
(a) depositing a pyrolytic graphite coating on the surface of a carbon anode body, said coating having a plurality of crystallographic layers extending parallel to said surface;
(b) cutting through the coating at an angle exposing ends of the crystallographic layers to form a face; and
(c) providing an X-ray generating metallic layer on said face.

7. A method as in claim 6 where the rotary anode is subjected to heat treatment at a temperature between 2500° and 3500° C., after the pyrolytic graphite coating is deposited on the anode body.

* * * * *